United States Patent [19]

McClaflin

[11] 4,249,554

[45] Feb. 10, 1981

[54] METHOD OF TRANSPORTING VISCOUS HYDROCARBONS

[75] Inventor: Gifford G. McClaflin, Ponca City, Okla.

[73] Assignee: Conoco, Inc., Ponca City, Okla.

[21] Appl. No.: 6,624

[22] Filed: Jan. 26, 1979

[51] Int. Cl.[3] ..... F17D 1/17

[52] U.S. Cl. ..... 137/13; 252/8.55 R

[58] Field of Search ..... 252/8.55 R, 8.3; 137/13

[56] References Cited

U.S. PATENT DOCUMENTS

| | | | |
|---|---|---|---|
| 3,380,531 | 4/1968 | McAuliffe et al. | 166/314 |
| 3,398,094 | 8/1968 | Blatz et al. | 252/8.55 |
| 3,467,195 | 9/1969 | McAuliffe et al. | 166/314 |
| 3,491,835 | 1/1970 | Gagle | 137/13 |
| 3,735,770 | 5/1973 | Day et al. | 137/13 |
| 3,943,954 | 3/1976 | Flournoy et al. | 137/13 |
| 4,099,537 | 7/1978 | Kalfoglou et al. | 137/13 |
| 4,108,193 | 8/1978 | Flournoy et al. | 137/13 |

*Primary Examiner*—Herbert B. Guynn

*Attorney, Agent, or Firm*—Bayless E. Rutherford, Jr.

[57] ABSTRACT

An improvement in the method of transporting viscous hydrocarbons through pipes is disclosed. Briefly, the improvement comprises adding water containing an effective amount of a combination of an ethoxylated alkyl phenol and a sodium or ammonium salt of an ethoxylated alcohol sulfate. The resulting emulsion has a lower viscosity and is more easily transported.

14 Claims, No Drawings

METHOD OF TRANSPORTING VISCOUS HYDROCARBONS

BACKGROUND OF THE INVENTION

Field of the Invention

The invention is in the general field of improved methods of pumping viscous hydrocarbons through a pipe, such as a well-bore or a pipeline.

GENERAL BACKGROUND

The movement of heavy crudes through pipes is difficult because of their high viscosity and resulting low mobility. One method of improving the movement of these heavy crudes has included adding to the crude lighter hydrocarbons (e.g. kerosine distillate). This reduces the viscosity and thereby improves the mobility. This method has the disadvantage that it is expensive and the kerosine distillate is becoming difficult to obtain.

Another method of improving the movement of these heavy crudes is by heating them. This requires the installation of expensive heating equipment and thus is an expensive process.

Still another method of moving heavy crudes through pipes uses oil-in-water emulsions which use surfactants to form the emulsions.

I have found that use of an aqueous solution containing a combination of an ethoxylated alkyl phenol and an ethoxylated alcohol sodium sulfate provides better viscosity reduction than use of either material alone.

BRIEF SUMMARY OF THE INVENTION

Briefly stated, the present invention is directed to an improvement in the method of pumping a viscous hydrocarbon through a pipe wherein the improvement comprises forming an oil-in-water emulsion by adding to said hydrocarbon from about 20 to about 80 volume percent water containing an effective amount of a combination of an ethoxylated alkyl phenol and a sodium or ammonium salt of an ethoxylated alcohol sulfate.

The specific nature of the ethoxylated alkyl phenol and the ethoxylated alcohol sodium sulfate are provided in the detailed description.

DETAILED DESCRIPTION

Insofar as is known our method is suitable for use with any viscous crude oil. It is well known that crude oils often contain a minor amount of water.

The amount of water which is added to the hydrocarbon is suitably in the range of about 20 to about 80 volume percent based on the hydrocarbon. A preferred amount of water is in the range of about 30 to 60 volume percent. The water can be pure of can have a relatively high amount of dissolved solids. Any water normally found in the proximity of a producing oil-well is suitable.

Suitable ethoxylated alkyl phenols are mono- or dialkyls, wherein each alkyl group contains from about 8 to 12 carbon atoms, and which contain from about 35 to about 100 ethoxy groups, preferably from about 40 to about 70 ethoxy groups. The preferred ethoxylated alkyl phenols are monooctyl phenol and monononyl phenol.

My invention uses certain specific ethoxylated alcohol sulfates which can be represented by the following structural formula $$[CH_3(CH_2)_xCH_2(OCH_2CH_2)_nOSO_3]M$$

wherein X is an integer in the range of about 8 to about 20, preferably from about 10 to about 16, n is a number in the range of about 1 to about 50, preferably about 2 to about 30, more preferably about 3 to about 12, and M is $NH_4$ or Na, but preferably is sodium.

The alcohol moiety of the ethoxylated alcohol sulfate can be an even or odd number or a mixture thereof. Preferably, the alcohol moiety is an even number. Also, preferably, the alcohol moiety contains 12 to 18 carbon atoms.

Suitable ethoxylated octyl phenols are available from Rohm and Haas Company, under the tradename "TRITON", for example, TRITON X-405, containing 40 moles of ethylene oxide, and TRITON X-705, containing 70 moles of ethylene oxide.

Suitable and preferred amounts of the ethoxylated alkyl phenol and the ethoxylated alcohol sulfate, based on the hydrocarbon, are shown below.

| | (parts per million) | |
|---|---|---|
| | Suitable | Preferred |
| Ethoxylated alkyl phenol | 50–10,000 | 100–1,000 |
| Ethoxylated alcohol sulfate | 50–10,000 | 100–1,000 |

In order to illustrate the nature of the present invention still more clearly the following examples will be given. It is to be understood, however, that the invention is not to be limited to the specific conditions or details set forth in these examples except insofar as such limitations are specified in the appended claims.

The following materials were used in the tests described herein:

Crude Oil—Goodwin lease crude from Cat Canyon oil field, Santa Maria, Calif.

Water—Goodwin synthetic (Water prepared in laboratory to simulate water produced at the well. In contained 4720 ppm total solids.)

The specific composition of the surfactant materials tested will be given in the examples.

Viscosities were determined using a Brookfield viscometer, Model LVT with No. 3 spindle. The procedure is described below.

TEST PROCEDURE

Three hundred ml of crude oil, preheated in a large container to about 93° C. in a laboratory oven, was transferred to a Waring blender and stirred at medium speed until homogeneous. Stirring was stopped, temperature recorded, and the viscosity measured using the Brookfield viscometer at RPM's (revolutions per minute) of 6, 12, 30 and 60. Viscosity was calculated by using a multiplication factor of 200, 100, 40 and 20 for the respective speeds times the dial reading on the viscometer.

It may be well to mention that the fuel result at 6 RPM is an indication of the stability of the solution being tested.

The difference in viscosity values on the crude alone in the examples is due to the varying amount of water naturally present in the crude. For this reason the viscosity value of the crude alone was obtained in each example. The crude corresponded to that used in combination with the aqueous surfactant.

EXAMPLE 1

This example is comparative and shows the viscosity values obtained on the crude alone and a combination of 50 volume percent crude oil and 50 volume percent water which contained 500 ppm of an ethoxylated octyl phenol containing 70 moles of ethylene oxide.

The results are shown in Table I.

TABLE I

| Crude Oil Alone (300 ML) | | | Crude Oil Plus 300 ml Goodwin Synthetic Water Containing 500 ppm Of The Described Ethoxylated Octyl Phenol | | | |
|---|---|---|---|---|---|---|
| | Dial | Viscosity | Dial Reading | | Viscosity cp | |
| RPM | Reading | cp | No. 1 | No. 2* | No. 1 | No. 2 |
| 6 | 18 | 3,600 | 0.5 | 12 | 100 | 2,400 |
| 12 | 38 | 3,800 | 1 | 18 | 100 | 1,800 |
| 30 | 93 | 3,720 | 1 | 32 | 40 | 1,280 |
| 60 | Offscale | — | 3 | 56 | 60 | 1,120 |
| 30 | 93 | 3,720 | 1.5 | 29 | 60 | 1,160 |
| 12 | 37 | 3,700 | 1.5 | 13 | 150 | 1,300 |
| 6 | 18 | 3,600 | 1.75 | 8 | 350 | 1,600 |
| Test Temperature 91° C. | | | 79° C.(1), 71° C.(2) | | | |

*After (2-min) delay. Emulsion contained very little foam.

EXAMPLE 2

This example is comparative and shows the viscosity values obtained on the crude alone and a combination of 50 volume percent crude oil and 50 volume percent water which contained 600 ppm of the sodium salt of a sulfated ethoxylate derived from a $C_{12}$–$C_{14}$ linear primary alcohol blend and containing 7 moles of ethylene oxide.

The results are shown in Table II.

TABLE II

| Crude Oil Alone (300 ml) | | | Crude Oil Plus 300 ml Goodwin Synthetic Water Containing 600 ppm Of The Described Sulfated Ethoxylate | | | |
|---|---|---|---|---|---|---|
| | Dial | Viscosity | Dial Reading | | Viscosity cp | |
| RPM | Reading | cp | No. 1 | No. 2* | No. 1 | No. 2 |
| 6 | 20 | 4,000 | 0.6 | 11 | 120 | 2,200 |
| 12 | 39.5 | 3,950 | 1.5 | 13 | 150 | 1,300 |
| 30 | 95 | 3,800 | 2.7 | 21 | 108 | 840 |
| 60 | Offscale | — | 4 | 34 | 80 | 680 |
| 30 | 89 | 3,560 | 4 | 23 | 160 | 920 |
| 12 | 34.5 | 3,450 | 3.5 | 14 | 350 | 1,400 |
| 6 | 17 | 3,400 | 3.7 | 12 | 740 | 2,400 |
| Test Temperature 93° C. | | | 71° C.(1), 66° C.(2) | | | |

*After (2-min) delay. Blender jar full of foam.

EXAMPLE 3

This example is illustrative and shows the viscosity values obtained on the crude alone and a combination of 50 volume percent crude oil and 50 volume percent of water containing 250 ppm of the surfactant material of Example 1 and 250 ppm of the surfactant material of Example 2.

The results are shown in Table III.

TABLE III

| Crude Oil Alone (300 ml) | | | Crude Oil Plus 300 ml Goodwin Synthetic Water Containing 500 ppm Of The Described Combination | | | |
|---|---|---|---|---|---|---|
| | Dial | Viscosity | Dial Reading | | Viscosity cp | |
| RPM | Reading | cp | No. 1 | No. 2* | No. 1 | No. 2 |
| 6 | 14.4 | 2,880 | 0.2 | 0.2 | 40 | 40 |
| 12 | 24.7 | 2,470 | 0.3 | 0.3 | 30 | 30 |

TABLE III-continued

| Crude Oil Alone (300 ml) | | | Crude Oil Plus 300 ml Goodwin Synthetic Water Containing 500 ppm Of The Described Combination | | | |
|---|---|---|---|---|---|---|
| | Dial | Viscosity | Dial Reading | | Viscosity cp | |
| RPM | Reading | cp | No. 1 | No. 2* | No. 1 | No. 2 |
| 30 | 61.7 | 2,456 | 0.6 | 0.6 | 24 | 24 |
| 60 | Offscale | — | 0.8 | 1.1 | 16 | 22 |
| 30 | 57.4 | 2,296 | 0.7 | 0.6 | 28 | 24 |
| 12 | 21.5 | 2,150 | 0.3 | 0.2 | 30 | 20 |
| 6 | 11 | 2,200 | 0.2 | 0.1 | 40 | 20 |
| Test Temperature 100° C. | | | 82° C. (1), 77° C. (2) | | | |

*After (2-min) delay. Little or no foam.

EXAMPLE 4

This example is comparative and shows the viscosity values obtained on the crude alone and a combination of 50 volume percent crude oil and 50 volume percent of water containing 125 ppm of the surfactant of Example 2 and 125 ppm of an ethoxylated octyl phenol containing 30 moles of ethylene oxide.

The results are shown in Table IV.

TABLE IV

| Crude Oil Alone (300 ml) | | | Crude Oil Plus 300 ml Goodwin Synthetic Water Containing 250 ppm Of The Described Combination | |
|---|---|---|---|---|
| RPM | Dial Reading | Viscosity cp | Dial Reading | Viscosity cp |
| 6 | 31.2 | 6,240 | 14 | 2,800 |
| 12 | 59.4 | 5,940 | 29.5 | 2,950 |
| 30 | Offscale | — | 46 | 1,840 |
| 60 | Offscale | — | 76 | 1,520 |
| 30 | Offscale | — | 40.7 | 1,628 |
| 12 | 62.8 | 6,280 | 17.6 | 1,760 |
| 6 | 31.3 | 6,260 | 9.4 | 1,880 |
| Test Temperature 78° C. | | | Test Temperature 71° C. | |

EXAMPLE 5

This example is comparative and shows the viscosity values obtained on a combination of 50 volume percent crude oil and 50 volume percent of water containing 250 ppm of an ethoxylated octyl phenol containing 40 moles of ethylene oxide.

The results are shown in Table V.

TABLE V

| | Crude Oil Plus 300 ml Goodwin Synthetic Water Containing 250 ppm Of The Described Ethoxylated Octyl Phenol | |
|---|---|---|
| RPM | Dial Reading | Viscosity cp |
| 6 | 4 | 800 |
| 12 | 7.3 | 730 |
| 30 | 6.4 | 256 |
| 60 | 6.6 | 132 |
| 30 | 5 | 200 |
| 12 | 7.5 | 750 |
| 6 | 10 | 2,000 |
| | Test Temperature 79° C. | |

EXAMPLE 6

This example is illustrative and shows the viscosity values obtained on the crude alone and a combination of 50 volume percent crude oil and 50 volume percent of water containing 125 ppm of the surfactant of Example 2 and 125 ppm of the ethoxylated octyl phenol containing 40 moles of ethylene oxide of Example 5.

The results are shown in Table VI.

TABLE VI

| | Crude Oil Alone (300 ml) | | Crude Oil Plus 300 ml Goodwin Synthetic Water Containing 250 ppm Of The Described Combination | |
|---|---|---|---|---|
| RPM | Dial Reading | Viscosity cp | Dial Reading | Viscosity cp |
| 6 | 39.7 | 7,940 | 0.3 | 60 |
| 12 | 76.7 | 7,670 | 3 | 300 |
| 30 | Offscale | — | 1.5 | 60 |
| 60 | Offscale | — | 2.8 | 56 |
| 30 | Offscale | — | 2 | 80 |
| 12 | 67.8 | 6,780 | 0.6 | 60 |
| 6 | 33 | 6,600 | 0.3 | 60 |
| Test Temperature 86° C. | | | Test Temperature 72° C. | |

EXAMPLE 7

This example is illustrative and shows the viscosity values obtained on the crude alone and a combination of 50 volume percent crude oil and 50 volume percent water containing 125 ppm of the surfactant of Example 2 and 125 ppm of an ethoxylated mononnyl phenol containing 50 moles of ethylene oxide.

The results are shown in Table VII.

TABLE VII

| | Crude Oil Alone (300 ML) | | Crude Oil Plus 300 ml Goodwin Synthetic Water Containing 250 ppm Of The Described Combination | |
|---|---|---|---|---|
| RPM | Dial Reading | Viscosity cp | Dial Reading | Viscosity cp |
| 6 | 56.8 | 11,360 | 0.3 | 60 |
| 12 | Offscale | — | 0.3 | 30 |
| 30 | Offscale | — | 1.5 | 60 |
| 60 | Offscale | — | 2 | 40 |
| 30 | Offscale | — | 3 | 120 |
| 12 | Offscale | — | 0.5 | 50 |
| 6 | 61.5 | 12,300 | 0.3 | 60 |
| Test Temperature 70° C. | | | Test Temperature 66° C. | |

Thus, having described the invention in detail, it will be understood by those skilled in the art that certain variations and modifications may be made without departing from the spirit and scope of the invention as defined herein and in the appended claims.

I claim:

1. In the method of pumping a viscous hydrocarbon through a pipe the improvement which comprises forming an oil-in-water emulsion by adding to said hydrocarbon from about 20 to about 80 volume percent of an aqueous solution containing an effective amount, based on said hydrocarbon, of a combination of about 50 to about 10,000 parts per million of an ethoxylated alkyl phenol and about 50 to about 10,000 parts per million of an ethoxylated alcohol sulfate, said ethoxylated alkyl phenol being a monoalkyl phenol wherein the alkyl group contains from about 8 to about 12 carbon atoms, and which contains from about 40 to about 70 ethoxy groups, and said ethoxylated alcohol sulfate is represented by the formula $$[CH_3(CH_2)_xCH_2(OCH_2CH_2)_nOSO_3]M$$

wherein x is an integer in the range of about 10 to about 16, n is a number in the range of about 1 to about 50, and M is ammonium or sodium.

2. The method of claim 1 wherein the ethoxylated monoalkyl phenol is ethoxylated octyl phenol.

3. The method of claim 1 wherein M is sodium.

4. The method of claim 3 wherein said hydrocarbon is a crude oil.

5. The method of claim 4 wherein the ethoxylated alkyl phenol is ethoxylated nonyl phenol.

6. The method of claim 1 wherein the amount of aqueous solution added to said hydrocarbon is in the range of about 30 to about 60 volume percent, based on said hydrocarbon.

7. The method of claim 6 wherein the aqueous solution contains, based on said hydrocarbon, a combination of about 100 to about 1,000 parts per million of an ethoxylated alkyl phenol and about 100 to about 1,000 parts per million of an ethoxylated alcohol sulfate.

8. The method of claim 7 wherein M is sodium.

9. The method of claim 8 wherein said hydrocarbon is a crude oil.

10. The method of claim 9 wherein the ethoxylated monoalkyl phenol is ethoxylated octyl phenol.

11. The method of claim 9 wherein the ethoxylated alkyl phenol is ethoxylated nonyl phenol.

12. The method of claim 10 wherein the ethoxylated octyl phenol contains about 70 ethoxy groups.

13. The method of claim 1 wherein:

(a) the hydrocarbon is a crude oil;

(b) the amount of aqueous solution is about 50 volume percent; and (c) the aqueous solution contains about 250 parts per million of an ethoxylated octyl phenol containing 70 moles of ethylene oxide and about 250 parts per million of a sodium salt of a sulfated ethoxylate derived from a $C_{12}$–$C_{14}$ linear primary alcohol and containing 7 moles of ethylene oxide.

14. The method of claim 1 wherein:

(a) the hydrocarbon is a crude oil;

(b) the amount of aqueous solution is about 50 volume percent; and (c) the aqueous solution contains about 125 parts per million of an ethoxylated octyl phenol containing 40 moles of ethylene oxide and about 125 parts per million of a sodium salt of a sulfated ethoxylate derived from a $C_{12}$–$C_{14}$ linear primary alcohol and containing 7 moles of ethylene oxide.

* * * * *